US008789368B2

(12) United States Patent
Kuhlbach et al.

(10) Patent No.: US 8,789,368 B2
(45) Date of Patent: Jul. 29, 2014

(54) INTERNAL COMBUSTION ENGINE WITH CYLINDER HEAD AND TURBINE

(75) Inventors: Kai Sebastian Kuhlbach, Bergisch Gladbach (DE); Ludwig Stump, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 255 days.

(21) Appl. No.: 13/347,389

(22) Filed: Jan. 10, 2012

(65) Prior Publication Data

US 2012/0174580 A1 Jul. 12, 2012

(30) Foreign Application Priority Data

Jan. 12, 2011 (DE) ..... 10 2011 002 554

(51) Int. Cl.
*F02D 23/00* (2006.01)

(52) U.S. Cl.
USPC ..... 60/602; 417/409

(58) Field of Classification Search
CPC .... F02B 39/005; F01D 25/14; F01P 2060/12; Y02T 10/144
USPC ..... 60/602; 417/409
See application file for complete search history.

(56) References Cited

U.S. PATENT DOCUMENTS

| | | | | |
|---|---|---|---|---|
| 4,147,467 | A * | 4/1979 | Leicht et al. | 415/196 |
| 8,459,024 | B2 * | 6/2013 | Koch | 60/605.3 |
| 2010/0095671 | A1 * | 4/2010 | Takagawa et al. | 60/602 |
| 2012/0067306 | A1 * | 3/2012 | Mehring et al. | 123/41.72 |
| 2013/0031901 | A1 * | 2/2013 | Kuhlbach et al. | 60/599 |

FOREIGN PATENT DOCUMENTS

| | | | | |
|---|---|---|---|---|
| DE | 102007017973 | A1 | 1/2008 | |
| DE | 102008011257 | A1 | 9/2009 | |
| EP | 1384857 | A2 | 1/2004 | |
| WO | WO 2011053513 | A2 * | 5/2011 | F02B 39/00 |

* cited by examiner

*Primary Examiner* — Kenneth Bomberg
*Assistant Examiner* — Ngoc T Nguyen
(74) *Attorney, Agent, or Firm* — Julia Voutyras; Alleman Hall McCoy Russell & Tuttle LLP

(57) ABSTRACT

The disclosure relates to an internal combustion engine which is optimized with regard to the cooling of a turbine. The engine has at least one cylinder head and block, forming at least one cylinder, and at least one turbine. Each cylinder has at least one exhaust opening for discharging the exhaust gases from the cylinder. An exhaust gas line is connected to each exhaust opening, the exhaust gas lines converging to produce at least one combined exhaust gas line, thereby forming at least one exhaust manifold, which opens into the at least one turbine having a turbine housing. The turbine has at least one flow channel conducting exhaust gas through the turbine housing, and at least one coolant passage integrated in the housing forming a cooling facility. At least one chamber is arranged between the at least one coolant passage and the at least one flow channel conducting exhaust gas.

20 Claims, 5 Drawing Sheets

INTERNAL COMBUSTION ENGINE WITH CYLINDER HEAD AND TURBINE

RELATED APPLICATIONS

The present application claims priority to German Patent Application No. 102011002554.5, filed on Jan. 12, 2011, the entire contents of which are hereby incorporated by reference for all purposes.

FIELD

The present disclosure relates to cooling an internal combustion engine having at least one cylinder head and at least one turbine, in which the at least one cylinder head has at least one cylinder, each cylinder having at least one exhaust opening for discharging the exhaust gases from the cylinder and an exhaust gas line being connected to each exhaust opening, the exhaust gas lines converging to produce at least one combined exhaust gas line while forming at least one exhaust manifold, which combined exhaust gas line opens into the at least one turbine having a turbine housing, which turbine has at least one flow channel conducting exhaust gas through the turbine housing, and the at least one turbine has at least one coolant passage integrated in the housing in order to form a cooling facility.

BACKGROUND AND SUMMARY

Internal combustion engines feature exhaust systems that may utilize a combined exhaust gas line, also known as an exhaust manifold, to direct exhaust gas to a turbine. In these systems, production costs, material costs, and/or weight of the turbine can be comparatively high, as the nickel-containing material used for the thermally highly-stressed turbine housing is cost-intensive, especially in comparison to the material, for example aluminum, preferably used for a cylinder head of the engine. Therefore, it would be extremely advantageous if a turbine could be made available which could be produced from a less cost-intensive and/or lighter material, for example aluminum or gray cast iron. In order to achieve such goals, the turbine can be equipped with a cooling facility, which greatly reduces the thermal stress on the turbine and turbine housing, thereby allowing for the use of less thermally resistant materials.

German patent DE 10 2008 011 257 A1 describes a liquid cooling facility for a turbine in the form of a cooling jacket that surrounds a turbine housing. The housing features a shell, so that a cavity into which coolant can be introduced is formed between the housing and the shell arranged at a distance therefrom. However, in such a system, coolant is only able to effectively cool areas in near its flow path, leaving remote areas of the housing to experience limited cooling. Thus, high temperature gradients can occur in the turbine housing, which can lead to material fatigue.

The descending temperature gradient in the housing can be reduced, in some cases, by providing a sufficient number of coolant passages, so that each housing part is located directly adjacent to a coolant passage, or by configuring the coolant passage as a coolant jacket which surrounds the flow channel with the largest possible area. Both measures lead to an equalization of temperature in extensive regions of the housing, but at the same time entail the dissipation of large quantities of heat. It may be borne in mind in this connection that the quantity of heat to be absorbed by the coolant in the turbine can be 40 kW or more, if less thermally resistant materials such as aluminum are used to produce the housing. To extract such a large quantity of heat from the coolant in the heat exchanger and to discharge it into the environment by air flow proves to be problematic.

Although modern motor vehicle drive units are equipped with powerful fan motors in order to make available to the heat exchangers the mass air flow required for a sufficiently large heat transfer, a further parameter which affects heat transfer, namely the surface area made available for the heat transfer, cannot be made of any desired size or enlarged to any desired degree, since the space available in the front end region of the vehicle, where the different heat exchangers are generally arranged, is limited.

Against the background of what has been said above, it is the object of the present disclosure to make available an internal combustion engine comprising at least one cylinder, formed from at least one cylinder block and at least one cylinder head and at least one turbine within a turbine housing. The engine is optimized with regard to cooling of the turbine, by each cylinder having at least one exhaust opening for discharging exhaust gases from the cylinder and an exhaust gas line being connected to each exhaust opening, the exhaust gas lines converging to produce at least one combined exhaust gas line forming at least one exhaust manifold, the combined exhaust gas line opening into the at least one turbine within the turbine housing; the turbine having at least one flow channel conducting exhaust gas through the turbine housing, and at least one coolant passage integrated in the housing in order to form a cooling facility; and at least one chamber being arranged between the at least one coolant passage and the at least one flow channel conducting exhaust gas.

With this structure, the turbine housing can be effectively cooled evenly, allowing it to be constructed from less expensive and/or lighter materials. In one example, the multiple coolant passages enables the coolant to reach remote areas of the housing, reducing the overall temperature of the housing and ensuring that large quantities of heat is not dissipated in one area (to reduce potential for boiling). In addition, the chambers that are arranged between the coolant passage and the flow channel in one embodiment create gaps that serve to shield areas from heat transfer, and ribs that serve to connect coolant passages to the areas that need cooling, thereby directing heat flow in a predetermined manner. In this way, heat flow can be controlled more effectively than prior systems have allowed, resulting in heat distribution that is customized for a given material and turbine configuration, and the ability to utilize less expensive and/or lighter materials with lower heat tolerances.

Further advantageous details and effects of the internal combustion engine are explained in greater detail below with reference to the configurations illustrated in the figures.

DETAILED DESCRIPTION

Figure 1:
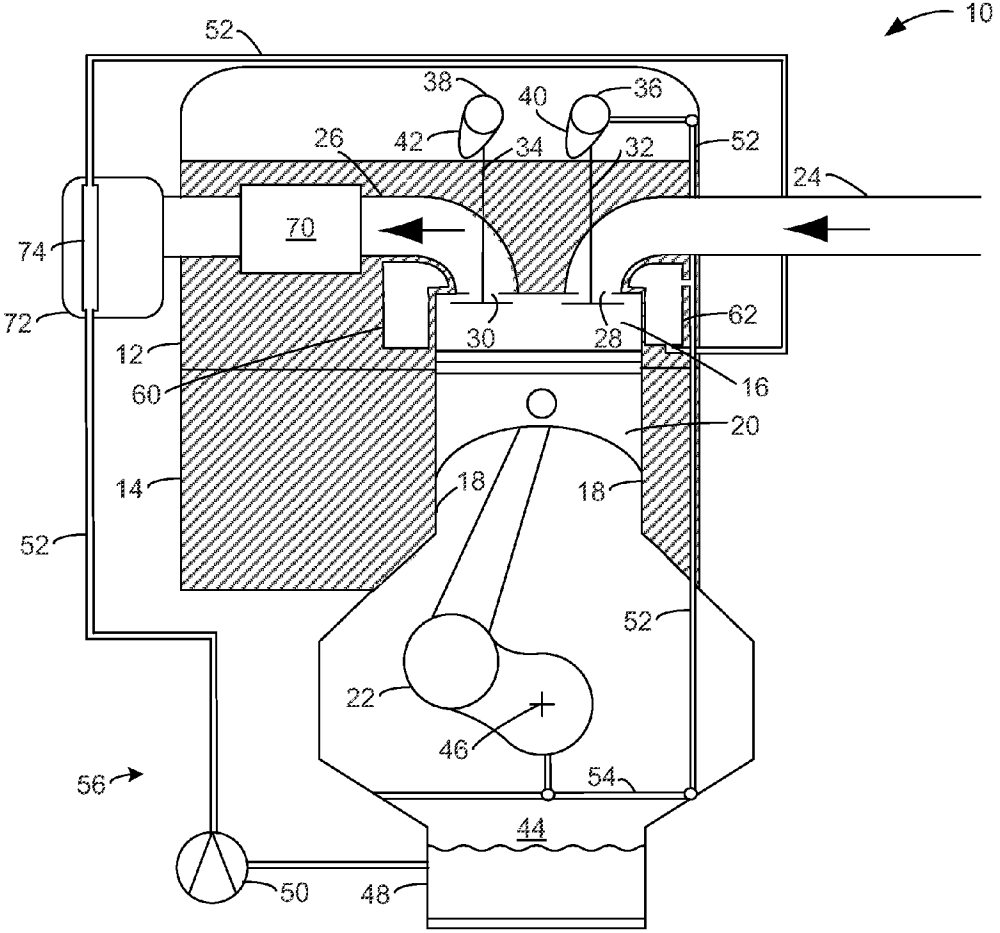
FIG. 1 schematically shows a cylinder of an internal combustion engine according to an embodiment of the present disclosure.

FIG. 1 is a schematic diagram showing one cylinder 16 of a multi-cylinder internal combustion engine 10. Cylinder block 14 and cylinder head 12 are connected to one another by their assembly faces to form a combustion chamber (for example, cylinder 16), which includes combustion chamber walls 18 with piston 20 positioned therein. Piston 20 may be coupled to crankshaft 22 so that the reciprocating motion of the piston is translated into rotational motion of the crankshaft. Crankshaft 22 may be coupled to at least one drive wheel of a vehicle via an intermediate transmission system. Further, a starter motor may be coupled to crankshaft 22 via a flywheel to enable a starting operation of engine 10.

Combustion chamber 16 may receive intake air via intake air line or intake air passage 24 through intake opening 28 and may exhaust combustion gases via exhaust line or exhaust passage 26 through exhaust opening 30. Exhaust passage 26 may be coupled to or combined with other exhaust passages to form exhaust manifold 70, which may be integrated into cylinder head 12. Intake valve 32 and exhaust valve 34 control the flow of air through intake opening 28 and exhaust opening 30, respectively. In some embodiments, each cylinder 16 may have two or more exhaust openings 30 for discharging the exhaust gases from the cylinder 16. A rapid opening of flow cross sections as large as possible is ideal in order to keep low the throttling losses in the outflowing exhaust gases and to ensure effective, for example total, discharge of the exhaust gases, therefore multiple exhaust openings 30 may be advantageous.

During operation, each cylinder within engine 10 may undergo a four stroke cycle: the cycle including the intake stroke, compression stroke, expansion stroke, and exhaust stroke. During the intake stroke, generally, the exhaust valve 34 closes and intake valve 32 opens.

Air is introduced into combustion chamber 16 via intake passage 24, and piston 20 moves to the bottom of the cylinder so as to increase the volume within combustion chamber 16. The position at which piston 20 is near the bottom of the cylinder and at the end of its stroke (e.g. when combustion chamber 16 is at its largest volume) is typically referred to by those of skill in the art as bottom dead center (BDC). During the compression stroke, intake valve 32 and exhaust valve 34 are closed. Piston 20 moves toward the cylinder head so as to compress the air within combustion chamber 16. The point at which piston 20 is at the end of its stroke and closest to the cylinder head (e.g. when combustion chamber 16 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as a spark plug (not shown), resulting in combustion. During the expansion stroke, the expanding gases push piston 20 back to BDC. Crankshaft 22 converts piston movement into a rotational torque of the rotary shaft. Finally, during the exhaust stroke, the exhaust valve 34 opens to release the combusted air-fuel mixture to exhaust passage 26 and the piston returns to TDC. Note that the above is shown merely as an example, and that intake and exhaust valve opening and/or closing timings may vary, such as to provide positive or negative valve overlap, late intake valve closing, or various other examples.

A valve actuating device depicted in FIG. 1 comprises two camshafts 36 and 38, on which a multiplicity of cams 40, 42 are arranged. A basic distinction is made between an underlying camshaft and an overhead camshaft. This relates to the parting plane, that is to say assembly surface, between the cylinder head and cylinder block. If the camshaft is arranged above said assembly surface, it is an overhead camshaft; otherwise it is an underlying camshaft. Overhead camshafts are preferably mounted in the cylinder head, and are depicted in FIG. 1.

The cylinder head 12 is connected, at an assembly end side, to a cylinder block 14 which serves as an upper half of a crankcase 44 for holding the crankshaft 22 in at least two bearings, one of which is depicted as crankshaft bearing 46. At the side facing away from the cylinder head 12, the cylinder block 14 is connected to an oil pan 48 which serves as a lower crankcase half and which is provided for collecting and storing engine oil. The oil pan 48 may serve as a heat exchanger for reducing the oil temperature when the internal combustion engine 10 has warmed up. Here, the oil situated in the oil pan 48 is cooled by means of heat conduction and convection by means of an air flow conducted past the outer side.

A pump 50 is provided for feeding the engine oil via a supply line 52 to a main engine oil gallery 54. The engine oil gallery 54 may be arranged above or below the crankshaft 22 in the crankcase 44 or else integrated into the crankshaft 22. Ducts lead from the main oil gallery to feed at least one consumer within an oil circuit 56. Example oil consumers include bearings of the camshaft and crankshaft, hydraulically actuable camshaft adjusters or other valve drive components, etc. In contrast, according to other systems, the supply line leads from the pump through the cylinder block to the camshaft receptacle, and in so doing, passes the so-called main oil gallery.

Cylinder head 12 may include one or more coolant jackets 60, 62. As depicted in FIG. 1, coolant jacket 60 is located between exhaust passage 26 and the assembly end side of cylinder head 12, while coolant jacket 62 is located between intake passage 24 and the assembly end side of cylinder head 12. The cylinder head 12 of the internal combustion engine 10 according to the disclosure may have two coolant circuits which are independent of one another and which comprise in each case at least one coolant jacket, and which in particular can be and preferably are operated with different coolants. One coolant jacket 62 is located on an inlet side of the cylinder, that is, the coolant jacket is integrated into the cylinder head 12 at the side of the cylinder that is adjacent to and surrounding the intake passage 24. Another coolant jacket 60 is located on an outlet side of the cylinder, that is, the coolant jacket 60 is integrated into the cylinder head 12 at the side of the cylinder that is adjacent to and surrounding the exhaust passage 26.

This configuration or design of the liquid cooling arrangement makes it possible for the inlet side and the outlet side to be cooled as required, specifically independently of one another and according to their respective demand.

According to the present disclosure, the at least one coolant jacket 60 and the at least one coolant jacket 62 of the other circuit are arranged such that different cooling capacities can be realized for the inlet side and the outlet side, specifically not only through the use of different coolants. Moreover, the pump power of each circuit, and therefore also the coolant throughput, that is to say the feed volume, can be selected and set independently of one another. In this way, it is possible to influence the throughflow speed, which significantly co-determines the heat transfer by convection. Thus, it is possible for less heat to be extracted from the cylinder head 12 at the inlet side and more heat to be extracted from the cylinder head 12 at the outlet side; or the reverse may occur as well.

As shown in FIG. 1, turbine 72 is coupled to cylinder head 12 on an outside of the cylinder head 12. However, in some embodiments, turbine 72 may be integrated in cylinder head 12. In order to provide a cooling mechanism to cool turbine 72, a coolant jacket 74 may be integrated in the housing of turbine 72. This turbine coolant jacket 74 may be part of oil circuit 56. Oil may be pumped from oil pan 48 via pump 50 in supply line 52 and fed through turbine coolant jacket 74 before entering the coolant jacket 62 on the inlet-side of cylinder head 12. In the embodiment depicted, the pump 50 and the coolant jacket 74 integrated in the housing are coupled to each other without an intervening consumer. In alternative embodiments, cooling jackets 74, 60 and/or 62 may be part of a circuit 56 that provides an alternate coolant. Such embodiments are described in more detail below.

Providing the turbine 72 with a liquid cooling arrangement makes it possible to use thermally less highly loadable materials for producing the turbine housing, for example makes it possible to use low-alloy steels, cast iron or aluminum. The housing of the turbine 72 may be produced from inexpensive materials on account of the liquid cooling arrangement provided, without having to dissipate excessively large amounts of heat, since the heat transfer in the housing is reduced in a targeted manner by the use of liquid coolant. Materials used for producing the turbine housing are discussed in more detail below.

Figure 2:
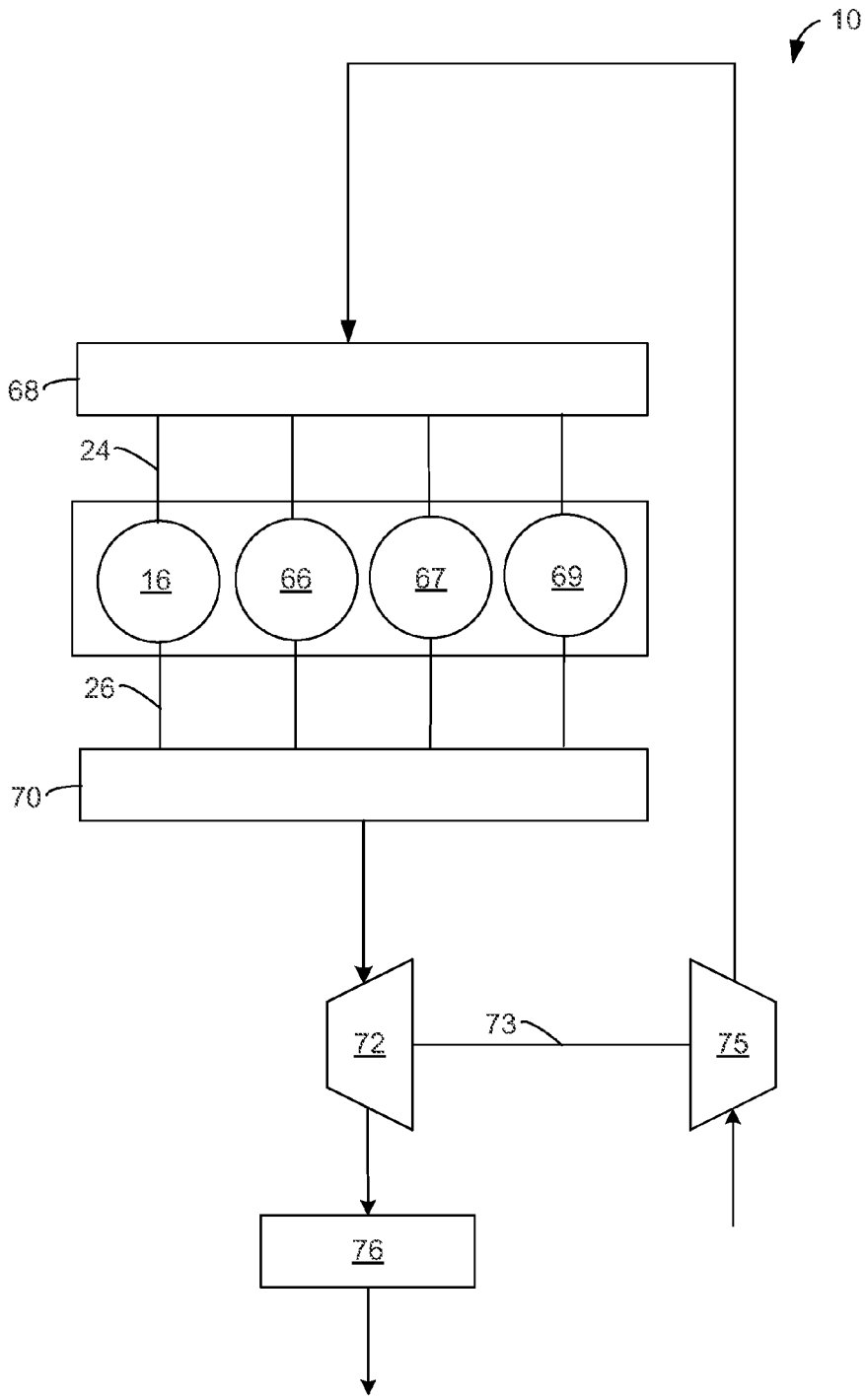
FIG. 2 shows a plurality of cylinders of the internal combustion engine shown in FIG. 1.

Turning to FIG. 2, the engine 10 described with reference to FIG. 1 is depicted. Here, multiple cylinders of engine 10 are shown. In addition to cylinder 16, cylinders 66, 67, and 69 are depicted. While engine 10 is here depicted as a four-cylinder engine, it is to be understood that any number of cylinders in any arrangement is within the scope of this disclosure.

An intake manifold 68 provides intake air to the cylinders via intake passages, such as intake passage 24. After combustion, exhaust gasses exit the cylinders via exhaust passages, such as exhaust passage 26, to the exhaust manifold 70. The exhaust lines of at least two cylinders may be merged to form an overall exhaust line within the cylinder head, so as to form an integrated exhaust manifold that permits the densest possible packaging of the drive unit. The exhaust gasses may pass through one or more aftertreatment systems 76 before exiting to the atmosphere.

In some embodiments, a cylinder head 12 may have two cylinders 16 and the exhaust gas lines 26 of just one cylinder 16 may form a combined exhaust gas line 70 opening into the turbine 72. Additionally or alternatively, a cylinder head 12 may have three or more cylinders 16 and the exhaust gas lines 26 of just two cylinders 16 may converge to form a combined exhaust gas line 70.

The at least one cylinder head 12 may also have, for example, four cylinders 16 arranged in line and the exhaust gas lines 26 of the outer cylinders 16 and the exhaust gas lines 26 of the inner cylinders 16 may each converge to form a respective combined exhaust gas line 70.

With three or more cylinders 16, therefore, embodiments can also be advantageous in which at least three cylinders 16 are configured in such a way that they form two groups, each group comprising at least one cylinder 16, and the exhaust gas lines 26 of the cylinders 16 of each group of cylinders 16 converge to form respective combined exhaust gas lines thereby forming an exhaust manifold 70.

The disclosure may also be suited to a dual-flow turbine 72. A dual-flow turbine 72 has an inlet region with two inlet channels, that is, in effect, two inlet regions, the two combined exhaust gas lines being connected to the dual-flow turbine 72 in such a way that each combined exhaust gas line opens into a respective inlet channel. The convergence of the two exhaust gas flows conducted in the combined exhaust gas lines optionally takes place downstream of the turbine 72. If the exhaust gas lines are grouped in such a way that the high pressures, in particular the pre-exhaust impulses, can be preserved, a dual-flow turbine 72 is especially suited to impulse charging, with which high turbine compression ratios can also be achieved at low engine speeds.

However, grouping of the cylinders 16 and of the exhaust gas lines 26 also offers advantages when using a plurality of turbines 72 or exhaust gas turbochargers, one combined exhaust gas line 70 being connected to one turbine 72 in each case.

However, embodiments in which the exhaust gas lines 26 of all the cylinders 16 of the at least one cylinder head 12 converge to form a single, that is, a common combined exhaust gas line 70 are also advantageous.

The engine 10 may be boosted or supercharged by means of an exhaust-gas turbocharger. The exhaust gas may pass through a turbine 72 to drive a compressor 75 to provide boosted intake air to engine 10. The turbine 72 may be coupled to the compressor by a shaft 73. Because of the relatively high exhaust gas temperatures, a boosted internal combustion engine is especially highly stressed thermally, for which reason cooling of the turbine of the exhaust gas turbocharger is advantageous. Therefore, embodiments in which the turbine 72 is a component of an exhaust gas turbocharger are advantageous in this context.

The boosting serves primarily to increase the power of the internal combustion engine 10. In this case the air required for the combustion process is compressed, whereby a larger air mass can be supplied to each cylinder 16 per working cycle. The fuel mass and therefore the mean pressure can thereby be increased.

Boosting is appropriate for increasing the power of an internal combustion engine 10 with unchanged cubic capacity, or for reducing the cubic capacity with the same power. In both cases, boosting leads to an increased power-to-volume ratio and a more favorable power-to-mass ratio. For the same basic vehicle conditions, therefore, the load spectrum can be shifted in the direction of higher loads, where the specific fuel consumption is lower. Consequently, boosting supports the constant effort in the development of internal combustion engines to minimize fuel consumption, that is, to increase the efficiency of the internal combustion engine 10.

As compared to a mechanical booster, the advantage of an exhaust gas turbocharger is that a mechanical connection for power transmission between booster and internal combustion engine is not required. While a mechanical booster draws the energy required to drive it directly from the internal combustion engine, the exhaust gas turbocharger utilizes the energy of the hot exhaust gases.

It may be taken into account that the fundamental aim is to arrange the turbine 72, in particular the turbine 72 of an exhaust gas turbocharger, as close as possible to the exhaust opening 30 of the cylinders 16, in order in this way to make optimum use of the exhaust gas enthalpy of the hot exhaust gases, which is determined by the exhaust gas pressure and the exhaust gas temperature, and to ensure rapid response behavior of the turbine 72 or turbocharger. In addition, the path of the hot gases to the different exhaust gas after-treatment systems 76 may be as short as possible, so that the exhaust gases are allowed little time for cooling and the exhaust gas after-treatment systems 76 reach their operating temperature or light-off temperature as quickly as possible, especially after a cold start of the internal combustion engine 10.

Efforts are therefore made to minimize the thermal inertia of the partial section of the exhaust gas line 26 between the exhaust opening 30 on the cylinder 16 and the turbine 72, and between the exhaust opening 30 on the cylinder 16 and the exhaust gas after-treatment system 76, which can be achieved by reducing the mass and length of this partial section.

The guiding principle here is to bring together the exhaust gas lines 26 inside the cylinder head 12 while forming at least one integrated exhaust manifold 70. The length of the exhaust gas lines 26 is thereby reduced. The line volume, that is, the exhaust gas volume of the exhaust gas lines 26 upstream of the turbine 72, is reduced, so that the response behavior of the turbine 72 is heightened. The shortened exhaust gas lines 26 also lead to reduced thermal inertia of the exhaust gas system upstream of the turbine 72, so that the temperature of the exhaust gases at the turbine inlet is increased, for which reason the enthalpy of the exhaust gases at the inlet of the turbine 72 is higher. In addition, the convergence of the exhaust gas lines 26 inside the cylinder head 12 enables tight packaging of the drive unit.

However, a cylinder head 12 with integrated exhaust manifold 70 is subjected to higher thermal stress than a conventional cylinder head which is equipped with an external manifold, and therefore places higher demands on the cooling facility.

The heat released during combustion by the exothermic, chemical conversion of the fuel is dissipated partially to the cylinder head 12 and the cylinder block 14 via the walls 18 delimiting the combustion chamber 16 and partially via the exhaust gas flow to the adjacent components and the environment. In order to keep the thermal stress on the cylinder head 12 within limits, a portion of the heat flow induced in the cylinder head 12 may be extracted again therefrom.

Because of the substantially higher thermal capacity of liquids as compared to air, substantially larger quantities of heat can be dissipated using liquid cooling than with air cooling, for which reason cylinder heads 12 of the type under discussion are advantageously equipped with liquid cooling.

The liquid cooling requires that the cylinder head 12 be equipped with at least one coolant jacket 60, 62, that is, the arrangement of coolant passages directing coolant through the cylinder head 12, necessitating a complex structure in the cylinder head 12 design. In this case, on the one hand the strength of the mechanically and thermally highly-stressed cylinder head 12 is reduced by the introduction of the coolant passages; on the other, the heat does not have to be first conducted to the cylinder head surface, as with air cooling, in order to be dissipated. The heat is already transferred to the coolant, sometimes water containing additives, in the interior of the cylinder head 12. In this case the coolant is conveyed by a pump 50 arranged in the circuit 56 so that it circulates in the coolant jacket 60, 62. In this way, the heat transferred to the coolant is dissipated from the interior of the cylinder head 12 and then removed from the coolant in a heat exchanger.

The bringing together of the exhaust gas lines 26 within the cylinder head 12, that is, the integration of the at least one exhaust manifold 70, in conjunction with the equipping of the cylinder head 12 with liquid cooling, leads to rapid heating of the coolant upon cold starting of the internal combustion engine 10, and therefore to more rapid warming up of the internal combustion engine 10 and, if a coolant-operated heater is provided for the passenger compartment of a vehicle, to more rapid heating of this passenger compartment.

Liquid cooling proves to be especially advantageous with boosted engines, since the thermal stress on boosted engines is significantly higher than on conventional internal combustion engines.

It follows from what has been said that embodiments of the internal combustion engine 10 in which the at least one cylinder head 12 is equipped with at least one coolant jacket 60, 62 integrated in the cylinder head 12 in order to form a liquid cooling facility are advantageous.

Embodiments of the internal combustion engine 10 in which the at least one coolant jacket 60, 62 integrated in the cylinder head 12 is connected to the at least one coolant passage 83 of the turbine 72 are advantageous.

If the at least one coolant jacket 60, 62 integrated in the cylinder head 12 is connected to the at least one coolant passage 83 of the turbine 72, the other components and units required to form circuit 56 may, in principle, to be provided singly, since they can be used both for the circuit 56 of the turbine 72 and for that of the internal combustion engine 10, leading to synergies and cost savings, but also to a weight saving. For example, one pump 50 for conveying the coolant and one container 48 for storing the coolant is preferably provided. The heat dissipated to the coolant in the cylinder head 12 and in the turbine housing 80 can be removed from the coolant in a common heat exchanger. In addition, the at least one coolant passage 83 of the turbine 72 can be supplied with coolant via the cylinder head 12.

Embodiments of the internal combustion engine 10 are advantageous in which the at least one cylinder head 12 is connectable to a cylinder block 14 by an assembly face, and the at least one coolant jacket 60, 62 integrated in the cylinder head 12 comprises a lower coolant jacket which is arranged between the exhaust gas lines 26 and the assembly face of the cylinder head 12, and an upper coolant jacket which is arranged on the side of the exhaust gas lines 26 opposite to the lower coolant jacket.

In this case, embodiments in which the lower coolant jacket and/or the upper coolant jacket is/are connected to the coolant jacket of the turbine 72 are advantageous.

Embodiments in which at least one connection between the lower coolant jacket and the upper coolant jacket is provided at a distance from the exhaust gas lines 26 on the side oriented away from the at least one cylinder 16, which connection serves to allow coolant to pass through, are advantageous. The cylinder head 12 then has at least one connection which is arranged in an outer wall of the cylinder head 12, that is, outside the at least partially integrated exhaust manifold 70.

The connection is an opening or a through-flow channel which connects the lower coolant jacket to the upper coolant jacket and through which coolant can flow from the lower coolant jacket into the upper coolant jacket and/or inversely.

Firstly, cooling thereby also takes place in principle in the region of the outer wall of the cylinder head 12. Secondly, the conventional longitudinal flow of the coolant, that is, the coolant flow in the direction of the longitudinal axis of the cylinder head 12, is supplemented by a transverse coolant flow disposed transversely to the longitudinal flow and preferably approximately in the direction of the longitudinal cylinder axes. In this case the coolant flow conducted through the at least one connection contributes predominantly to the dissipation of heat. The cooling can be more effective by the generation of a descending pressure gradient between the upper and lower coolant jackets, whereby the velocity in the at least one connection is increased, leading to increased heat transfer as a result of convection.

Such a descending pressure gradient also has advantages if the lower coolant jacket and the upper coolant jacket are connected to the coolant passage 83 of the turbine 72. The pressure gradient then serves as a motive force for conveying the coolant through the coolant passage 83 of the turbine 72.

Figure 3:
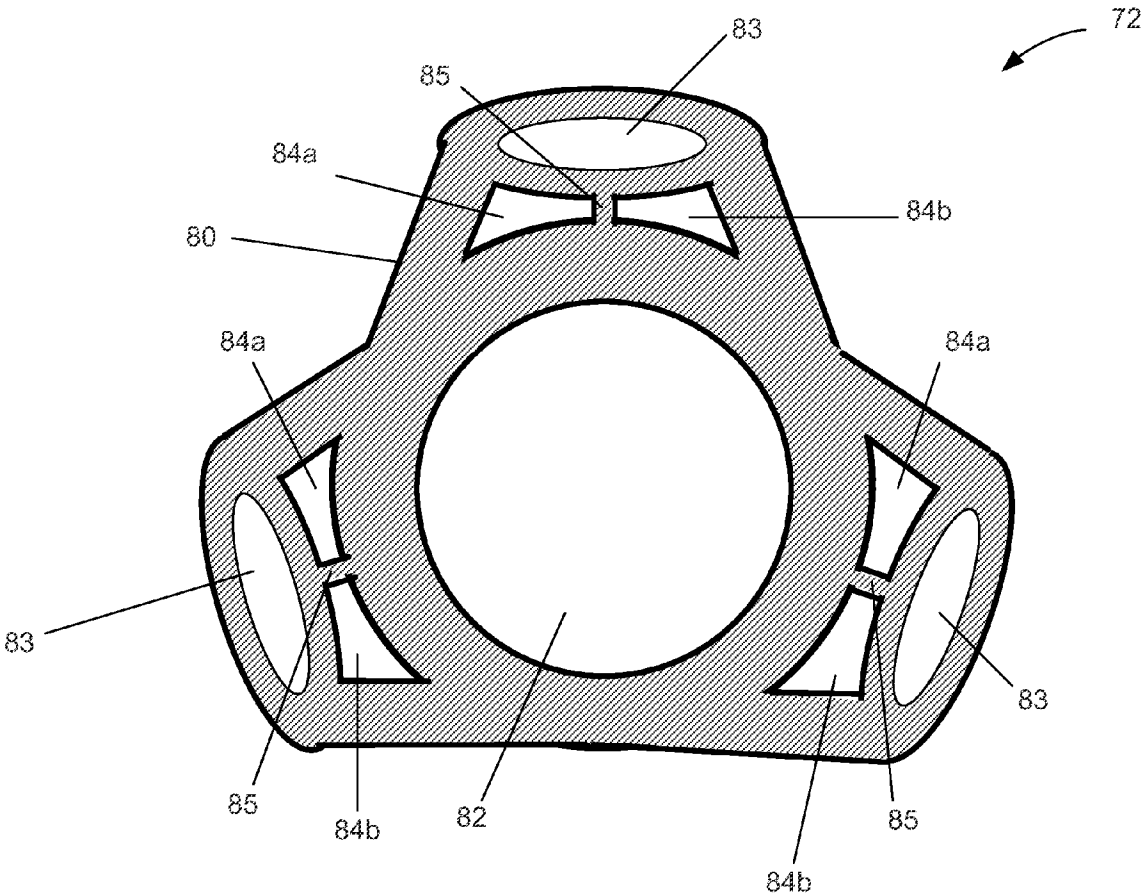
FIG. 3 shows a turbine housing of the turbine of FIG. 1 in a section perpendicular to the exhaust gas flow.

FIG. 3 shows the turbine 72 containing turbine housing 80 in a first embodiment in a section perpendicular to the exhaust gas flow.

Exhaust gas of an internal combustion engine is supplied to the turbine 72 via exhaust gas line 26. The turbine 72 may be in the form of a radial turbine, that is, the inflow against the rotating blades takes place substantially radially. In this case, "substantially radially" means that the velocity component in the radial direction is greater than the axial velocity component. The velocity vector of the flow intersects the shaft or axis of the turbine, specifically at right angles, if the flow is directed precisely radially. In order to direct the flow against the moving blades radially, the inlet region for supplying the exhaust gas is frequently in the form of a spiral or worm casing disposed all round the turbine 72, so that the inflow of exhaust gas to the turbine 72 takes place substantially radially.

However, the turbine 72 may also be in the form of an axial turbine, in which the velocity component in the axial direction is greater than the velocity component in the radial direction.

The turbine 72 may be equipped with variable turbine geometry, which allows extensive adaptation to the operating point of the internal combustion engine 10 at a given time by adjusting the turbine geometry or the effective turbine cross section. In this case, adjustable guide vanes may be arranged in the inlet region of the turbine 72 in order to influence the flow direction. Unlike moving blades of a revolving rotor, the guide vanes do not rotate with a shaft of the turbine 72.

If the turbine 72 has fixed, unchangeable geometry, the guide vanes are arranged in not only a stationary but also in a fully immovable manner in the inlet region, that is, they are fixed rigidly. With variable geometry, by contrast, although the guide vanes are stationary they are not completely immobile, but are rotatable about their axes, so that the inflow against the moving blades can be influenced.

The turbine 72 including a turbine housing 80 has a flow channel 82, implemented in the housing 80 and guiding the exhaust gas through the turbine 72. In order to form a cooling facility, three coolant passages 83, which are arranged at regular distances from one another on a circumference around the flow channel 82, are integrated in the housing 80.

In some embodiments, at least two chambers 84*a*, 84*b* are provided in the housing 80 in each case between each of the three coolant passages 83 and the one flow channel 82 conducting exhaust gas, and function as a thermal barrier that impedes and thereby reduces the direct flow of heat from the flow channel 82 to the coolant passage 83. The chambers 84*a*, 84*b* are located between the flow channel 82 and the coolant passage 83, if the chamber 84*a*, 84*b*—in cross section—is arranged substantially within an envelope of the flow channel 82 and the coolant passage 83. The common dividing wall 85 disposed centrally between two chambers 84*a*, 84*b* extends between the respective coolant passage 83 and a flow channel 82 and serves as a thermal bridge.

The total of six chambers 84*a*, 84*b* of the embodiment represented in FIG. 3 may be filled with air. Generally, the chamber fills itself with air during production and assembly without special measures, supporting the function of the chamber 84*a*, 84*b* as a thermal barrier. Although heat transfer in the region of the chamber 84*a*, 84*b* continues to be possible in principle through thermal conduction and thermal radiation, it is low, for example limited, because of the thermal conductivity or the insulating effect of the enclosed air.

However, at least one of the chambers 84*a*, 84*b* may be filled with a process fluid. This embodiment is characterized in that the chamber 84*a*, 84*b* is filled in a specified manner with a particular process fluid in order to increase the effect of the chamber 84*a*, 84*b* as a thermal barrier. A process gas which has lower thermal conductivity than air is preferably used.

The at least one chamber 84*a*, 84*b* may contain a vacuum. This embodiment is superior with regard to the formation of a thermal barrier between the flow channel 82 and the coolant passage 83, but requires special measures during production and assembly, whereby costs are increased.

By the design configuration, in particular the shaping or width of the dividing wall 85, of the chamber 84*a*, 84*b*, influence can be exerted on the heat flows and therefore on the distribution of temperature in the housing 80. While the chambers 84*a*, 84*b* lead to a reduced heat flow from housing regions located between the flow channel 82 and the chamber 84*a*, 84*b*, the heat flow via webs leading past the chamber 84*a*, 84*b*—that is, also the flow from housing regions which are more remote from the coolant passage 83 and are connected thereto via webs—increases. This contributes to a homogenization of the temperature distribution in the housing 80, that is, to a reduction of the descending temperature gradient which usually occurs in the housing 80, without the providing a large number of coolant passages 83 or to design the coolant passage 83 as a large-area coolant jacket, which—as described—would entail the dissipation of disadvantageously large quantities of heat.

As such, the heat flows, and therefore the temperature distribution, produced in the housing 80 in the course of cooling are influenced by the arrangement of at least one chamber 84*a*, 84*b*. Large temperature gradients which can lead to thermal stresses and to exceeding of the strength of the material are minimized or reduced in this way.

The entire housing 80 including the flow channel 82, the coolant passages 83 and the chambers 84*a*, 84*b* may be a component cast in one piece, that is, a monolithically constructed component. By casting and using suitable cores, the complex structure of the housing can be molded in a single work operation, so that merely finishing of the housing and assembly are then required in order to construct the turbine.

The cooling facility according to the disclosure makes it possible to dispense with thermally highly resistant, in particular nickel-containing, materials in producing the turbine housing 80, since the thermal stress on the material is reduced. In principle, aluminum can be used as the material, if that is permitted by the thermal stress on the turbine, which also depends on the configuration and performance of the cooling facility. An especially large weight saving is achieved thereby, in comparison to the use of steel. The costs for processing the aluminum component are also lower.

However, in keeping with the moderate cooling capacity, a suitable material may be chosen for producing the turbine 72 according to the disclosure, preferably gray cast iron, cast steel or the like, optionally with additives such as silicon-molybdenum (SiMo). Regardless of the type of material used, the advantages of a monolithic component according to the embodiment under discussion here are preserved, in particular the compact structure, the elimination of additional assembly tasks and the like.

Figure 4:
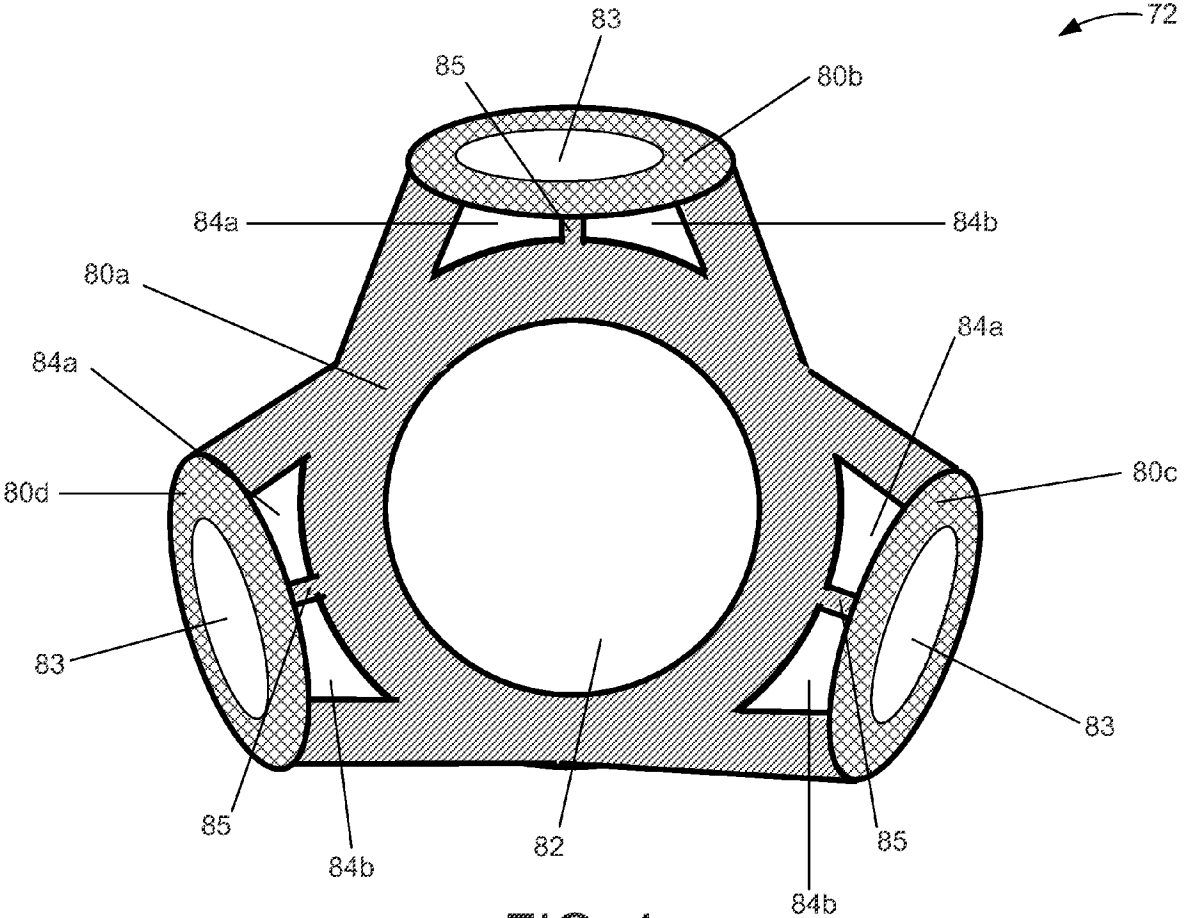
FIG. 4 shows the turbine housing of FIG. 3, in an embodiment including a modular construction of the housing, in a section perpendicular to the exhaust gas flow.

FIG. 4 shows the turbine housing 80 in a second embodiment in a section perpendicular to the exhaust gas flow. Only the differences from the embodiment represented in FIG. 3 will be described, for which reason reference is otherwise made to FIG. 3. The same reference numerals are used for identical components.

The turbine housing 80 represented in FIG. 2 is built up in modular fashion from four components 80*a*, 80*b*, 80*c*, 80*d* which, in the assembled state, are connected to one another by a material joint, that is, are welded. It is further contemplated, that turbine housing 80 may be built up from at least two components in a modular fashion, each of the at least two components being a casting, that is, a component produced using a casting process. In this case embodiments of the internal combustion engine 10 in which a first housing component 80*a* includes the at least one flow channel 82 conducting exhaust gas, a second housing component 80*b* includes the at least one coolant passage 83, and the two housing components together form the at least one chamber in the assembled state, are advantageous. As shown in FIG. 4, four modular housing components—a first housing component 80*a* including the flow channel 82 and three further housing components 80*b*, 80*c*, 80*d* each including a coolant passage 83—may, in their assembled state, together form the six chambers 84*a*, 84*b*.

A modular structure in which at least two components are to be connected to one another has the fundamental advantage that the individual components, in particular the component containing a coolant passage 83, can be used in different embodiments according to the modular principle. The multiple usability of a component generally increases the production volume, whereby manufacturing costs can be reduced.

In the case of internal combustion engines 10 with modular construction comprising two or more coolant passages 83 ($n \geq 2$), embodiments are advantageous which comprise (n+1) components, namely one housing component which includes the at least one flow channel 82, and n housing components which each include a coolant passage 83.

The at least two components may be connected to one another non-positively, positively and/or by a material joint. In this connection, embodiments in which the at least two components are connected to one another by a material joint in the assembled state are advantageous. Connection by a material joint has the advantage that no additional connecting elements are required, considerably simplifying manufacture, in particular assembly, that is, the forming of the connection.

Figure 5:
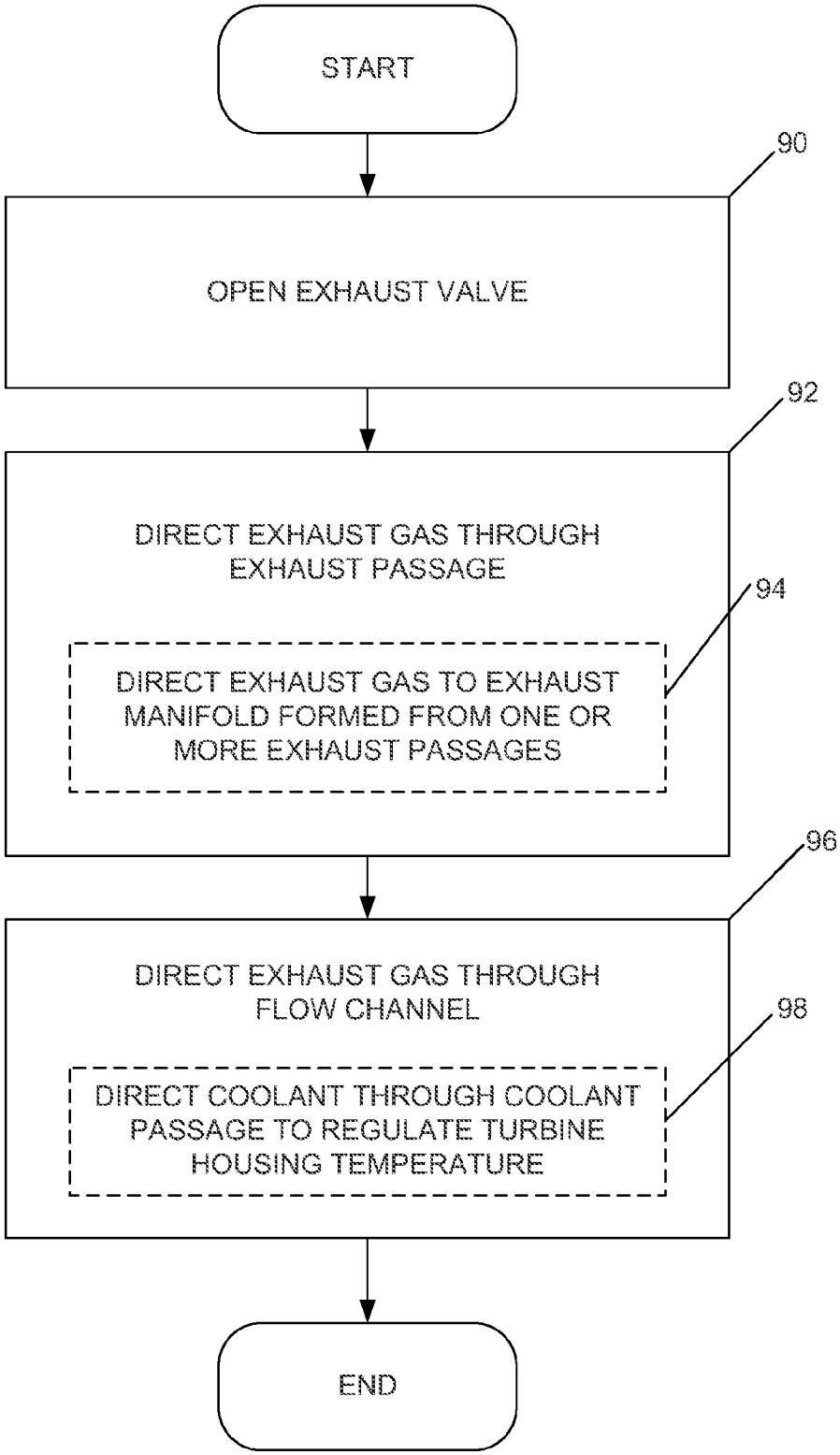
FIG. 5 shows an exemplary method of cooling the turbine housing of FIG. 3.

FIG. 5 shows an exemplary method of cooling the turbine housing 80 of FIG. 3. However, the method of FIG. 5 may also be utilized with the modular turbine housing 80 of FIG. 4. In step 90, the method begins at the exhaust stroke of the internal combustion engine 10, as the exhaust valve 34 is opened, releasing exhaust gas from the cylinder 16. At step 92, the exhaust gas is directed through at least one exhaust passage 26 in order to vacate cylinder 16. As exhaust passage 26 may form exhaust manifold 70 or may be combined with one or more other exhaust passages in order to form exhaust manifold 70, the exhaust gas is directed through exhaust manifold 70 at step 94. At step 96, exhaust gas exits exhaust manifold 70 and is directed through at least one flow channel 82 of turbine 72. As shown in step 98, the turbine housing 80 is cooled as coolant is directed through at least one coolant passage 83. In order to facilitate this cooling, at least one chamber 84*a*, 84*b* is arranged between the at least one coolant passage 83 and the at least one flow channel 82 conducting exhaust gas. In this way, turbine housing 80 may be cooled more effectively, allowing for less costly and lighter materials to be used for its construction.

The invention claimed is:

1. A method of cooling a turbine of an engine comprising:

directing exhaust gas through a flow channel of a turbine housing; and directing coolant through a coolant passage integrated in the turbine housing, a chamber arranged between the coolant passage and the flow channel providing a gap in the housing material between the coolant passage and the flow channel, wherein at least two chambers are arranged between the coolant passage and the flow channel conducting exhaust gas, a common dividing wall of the at least two chambers extending between the coolant passage and the flow channel and serving as a thermal bridge.

2. The method of claim 1, further comprising supplying engine oil to a coolant jacket in the turbine housing.

3. The method of claim 1, wherein at least two coolant passages are integrated in the turbine housing in order to form a cooling facility, and are arranged at a distance from one another on a circumference around the at least one flow channel.

4. The method of claim 1, wherein the turbine housing is built up in modular fashion from at least two components.

5. A method of cooling a turbine of an internal combustion engine comprising:

opening an exhaust valve, releasing exhaust gas from an exhaust opening of a cylinder;

directing the exhaust gas through an exhaust passage and into an exhaust manifold formed from at least one exhaust passage;

directing the exhaust gas from the exhaust manifold through at least one flow channel of a turbine housing;

directing coolant through at least one coolant passage integrated in the turbine housing, providing a thermal barrier that reduces direct flow of heat from the at least one flow channel and the at least one coolant passage via two chambers being arranged between the at least one coolant passage and the at least one flow channel conducting exhaust gas, the two chambers separated via a wall disposed centrally between the two chambers and extending between the at least one coolant passage and the at least one flow channel.

6. An internal combustion engine comprising:

a plurality of cylinders, formed from a cylinder block;

at least one cylinder head coupled to the cylinder block;

at least one turbine within a turbine housing;

each of the plurality of cylinders having at least one exhaust opening for discharging exhaust gases and an exhaust gas line being connected to the at least one exhaust opening, the exhaust gas line converging with other exhaust as lines to produce at least one combined exhaust gas line forming at least one exhaust manifold, the at least one combined exhaust gas line opening into the at least one turbine within the turbine housing;

the turbine having at least one flow channel conducting exhaust gas through the turbine housing, and at least one coolant passage integrated in the turbine housing in order to form a cooling facility; and at least one chamber being arranged between the at least one coolant passage and the at least one flow channel conducting exhaust gas; wherein at least two chambers are arranged between the at least one coolant passage and the at least one flow channel conducting exhaust gas, a common dividing wall of the at least two chambers extending between the at least one coolant passage and the at least one flow channel and serving as a thermal bridge.

7. The internal combustion engine of claim 6, wherein the turbine housing includes a coolant jacket in fluidic communication with an oil pump.

8. The internal combustion engine of claim 6, wherein the at least one chamber is filled with air.

9. The internal combustion engine of claim 6, wherein the at least one chamber is filled with a process fluid.

10. The internal combustion engine of claim 6, wherein the turbine housing is a component cast in one piece.

11. The internal combustion engine of claim 6, wherein the turbine housing is built up in modular fashion from at least two components.

12. The internal combustion engine of claim 11, wherein a first turbine housing component includes the at least one flow channel conducting exhaust gas, a second turbine housing component includes the at least one coolant passage and the first and second turbine housing components together form the at least one chamber in an assembled state.

13. The internal combustion engine of claim 11, wherein the at least two components are connected to one another by a material joint in an assembled state.

14. The internal combustion engine of claim 6, wherein the at least one turbine has at least two coolant passages integrated in the turbine housing in order to form the cooling facility.

15. The internal combustion engine of claim 14, wherein the at least two coolant passages are arranged in the turbine housing at a distance from one another on a circumference around the at least one flow channel.

16. The internal combustion engine of claim 15, wherein the at least two coolant passages are arranged at regular distances from one another in the turbine housing.

17. The internal combustion engine of claim 6, wherein the other exhaust gas lines converge inside the at least one cylinder head to produce at least one combined exhaust gas line forming at least one integrated exhaust manifold.

18. The internal combustion engine of claim 6, wherein the at least one cylinder head is equipped with at least one coolant jacket integrated in the cylinder head in order to form a liquid cooling facility.

19. The internal combustion engine of claim 18, wherein the at least one coolant jacket integrated in the cylinder head is connected to the at least one coolant passage of the turbine housing.

20. The internal combustion engine of claim 18, wherein the at least one cylinder head is connectable to a cylinder block by an assembly face, and the at least one coolant jacket integrated in the cylinder head comprises a lower coolant jacket which is arranged between the exhaust gas lines and the assembly face of the cylinder head.

* * * * *